US005491504A

United States Patent [19]

Grellman

[11] Patent Number: 5,491,504

[45] Date of Patent: Feb. 13, 1996

[54] THERMAL TRANSFER PRINTER INK RIBBON-CHANGING CAROUSEL APPARATUS AND METHOD

[75] Inventor: H. Erwin Grellman, Beaverton, Oreg.

[73] Assignee: Tektronix, Inc., Wilsonville, Oreg.

[21] Appl. No.: 91,487

[22] Filed: Jul. 13, 1993

[51] Int. Cl.[6] ..... B41J 2/325

[52] U.S. Cl. ..... 347/176; 347/174

[58] Field of Search ..... 347/176, 172, 347/174; 400/120.02, 120.04

[56] References Cited

U.S. PATENT DOCUMENTS

| | | | |
|---|---|---|---|
| 4,630,069 | 12/1986 | Erlichman | 346/76 PH |
| 4,647,232 | 3/1987 | Costa | 400/120 |
| 4,768,041 | 8/1988 | Sato et al. | 346/76 PH |
| 4,778,290 | 10/1988 | Costa et al. | 400/208 |
| 4,809,018 | 2/1989 | Nakamura et al. | 346/76 PH |
| 4,815,869 | 3/1989 | Van Dyke | 400/83 |
| 5,030,969 | 7/1991 | Kaneko et al. | 346/76 PH |

FOREIGN PATENT DOCUMENTS

| | | | |
|---|---|---|---|
| 4031191 | 4/1992 | Germany | 347/174 |

*Primary Examiner*—Huan H. Tran
*Attorney, Agent, or Firm*—Ralph D'Alessandro; Richard B. Preiss

[57] ABSTRACT

A thermal transfer color printer (100) utilizes a single print head (102) positioned outside a carousel (104) of monochrome ink ribbons (106) each stretched between a pair of spaced-apart spools (108, 110) mounted around the periphery of the carousel. A spool spacing (112) provides sufficient clearance for the thermal print head to be positioned between to spools to contact the ribbon. A media drum (116) is positioned coaxially within the carousel. The carousel has a media opening (122) through which a print medium (118) enters and exits a medium clamp (144) attached to the media drum. To print a particular color, the carousel is rotated such that the media opening is adjacent to a media supply, and a print medium is guided from the media supply into the medium clamp. The media drum is rotated to close the medium clamp and position a leading edge (138) of the print medium adjacent to the print head. The print head is moved against the ribbon, and the print head is electrically driven by a printer controller (240) to selectively transfer ink to the print medium in a predetermined pattern. To print a different color, the carousel is indexed to a selected ribbon position, the media drum is rotated to position the leading edge of the print medium as before, and the printing process is repeated for the newly selected ribbon color. When printing is completed, the carousel is indexed to the initial position, and the print medium is guided from the medium clamp into the exit path.

22 Claims, 5 Drawing Sheets

THERMAL TRANSFER PRINTER INK RIBBON-CHANGING CAROUSEL APPARATUS AND METHOD

TECHNICAL FIELD

This invention relates to thermal transfer color printing (e.g., thermal wax transfer, dye diffusion thermal transfer, or the like) and more particularly to an apparatus and a method for indexing separate monochrome colored ink ribbons into a printing position adjacent to a thermal print head.

BACKGROUND OF THE INVENTION

Thermal transfer printing involves the controlled transfer of an ink (e.g., a colorant dispersed in a wax-based material) from a carrier such as a polymer ribbon onto a print medium surface. A thermal transfer printer having a print head with a large number of independently activatable heating elements per unit of length is one prior art apparatus employed for this purpose. The ribbon is placed within the printer such that the carrier side is adjacent to the heating elements, and the ink side is adjacent to a print media support upon which a print medium rests during printing.

To print an image, the print head contacts the ribbon, and ink is transferred to particular locations on the print medium surface when predetermined combinations of heating elements are activated adjacent to those image-forming locations. The ribbon is locally heated by the heating elements to a temperature at or above the melting point of the ink. In this manner, an amount of ink softens and adheres to the print medium at the predetermined locations to form the image.

Color images are printed with a ribbon that typically includes separate panels of differently colored inks such as the subtractive primary colors, yellow, magenta, and cyan. Color printing is accomplished by sequential passes of the print medium past the print head, each pass selectively transferring different colored inks at predetermined times.

Thermal printing ribbons are available with a single yellow, magenta, cyan, or black ink panel (a monochrome ribbon); repeating sets of yellow, magenta, and cyan ink panels; or repeating sets of yellow, magenta, cyan, and black panels (multicolor ribbons). Ribbons are typically supplied on spools that have encoded end caps to communicate to the printer whether the ribbon includes one, three, or four panels. Multicolor ribbons typically have an encoding stripe running along one edge of the length of the ribbon to communicate panel location and panel color data to the printer. Obviously, monochrome ribbons are easier to manufacture, do not require the encoding stripe, and are therefore less costly.

Therefore it would be preferable to use multiple monochrome ribbons rather than a multicolor ribbon for thermal transfer color printing. Other workers have tried using multiple monochrome ribbons, each having an associated thermal print head, for transferring ink from each ribbon to a print medium proper registration of images transferred from each of the different ribbons requires precise alignment of the print heads and accurate positional indexing of the print medium relative to the print heads. Unfortunately, the resulting mechanism is bulky and relatively complex, the electronics drivers are replicated four times, and a higher capacity power supply is required resulting in a cost that offsets any savings associated with using the monochrome ribbons.

To improve multi-pass color printing registration, some printers clamp an edge of the print medium to a media drum and wrap the print medium around the drum for printing. Such an arrangement provides accurate control of print medium positioning relative to the print head(s).

Copending U.S. Pat. Ser. No. 5,305,020 of Gibbons et al. Apr. 19, 1994 for A THERMAL TRANSFER PRINTER HAVING MEDIA PRE-COAT SELECTION APPARATUS AND METHODS, assigned to the assignee of this application, describes such a drum and medium clamp arrangement for use with a multicolor thermal transfer ribbon. Referring to FIG. 1, a thermal transfer printer 10 (hereafter "printer 10") is shown that includes a drum 12 that receives a print medium 14A from a media tray 16. (Print medium 14 is shown in printer 10 at three locations designated by a letter suffix, i.e., 14A, 14B, or 14C.) A leading edge 18 of print medium 14A is fed to a medium clamp 20 that secures print medium 14B to drum 12, which then rotates in a direction indicated by arrow 22 to wrap print medium 14B around drum 12.

Printer 10 also includes a multicolor thermal transfer ribbon 24 suspended between a supply spool 26 and a take-up spool 28. Take-up spool 28 is driven in a direction indicated by arrow 30 with a torque sufficient to feed ribbon 24 through a nip formed between drum 12 and a thermal print head 32 at a rate determined by the rotation of drum 12.

The type of ribbon 24 (black, three, or four panels) is encoded by hub length into a left hub 42 and a right hub 43 on supply spool 26. Hubs 42 and 43 are each of a normal or extended length and selectively activate a left microswitch 44 and/or a right microswitch 45 as listed in Table 1. The states of microswitches 44 and 45 are sensed by a printer controller 46.

TABLE 1

| RIBBON TYPE | LEFT SWITCH | RIGHT SWITCH |
|---|---|---|
| Black | On | On |
| Three panel | Off | Off |
| Four panel | On | Off |

Ribbon 24 further includes an opaque encoding stripe 48 having a coded marker 50 at location indicating the boundaries between panels 34, 36, 38, and 40. Coded marker 50 typically is a series of transparent stripes detectable by a photosensor array 52 mounted adjacent to thermal print head 32. The number of stripes in each coded marker 50 indicates to printer controller 46 which 15 of panels 34, 36, 38, or 40 is aligned with thermal print head 32.

In operation, printer 10 receives a print job at a data communications interface 54. The print job is transferred to a system bus 55 that is in communication with printer controller 46, a processor 56, and a memory 58. Processor 56 processes data and commands contained in the print job and transmits control and printing data to printer controller 46. Processor 56 executes the printer driver stored in memory 58 and exchanges data with a PostScript® interpreter.

After the print job is interpreted by processor 56 and stored as yellow, magenta, and cyan image data in memory 58, printer controller 46 causes print medium 14A to feed from media tray 16 to medium clamp 20 on drum 12. Medium clamp 20 is activated, and drum 12 is caused to rotate such that leading edge 18 of print medium 14B is just past the nip between drum 12 and thermal print head 32. Ribbon 24 is moved by take-up spool 28 until a coded marker 50 is detected by photosensor array 52 indicating that a yellow panel 36 is positioned under thermal print head 32. Drum 12 is rotated one revolution, and yellow panel 36 is moved through the nip while all the image data stored in memory 58 simultaneously drives thermal print head 32, thereby thermally transferring a yellow image to print medium 14B and advancing ribbon 24 such that magenta panel 38 is in the nip. Drum 12 is rotated a second revolution, and magenta panel 38 is moved through the nip while the magenta image data stored in memory 58 simultaneously drives thermal print head 32, thereby thermally transferring a magenta image to print medium 14B and advancing ribbon 24 such that cyan panel 40 is in the nip. The sequence is repeated for the cyan image data until a full color image is transferred and registered on print medium 14B. Drum 12 reverses and rotates in the direction of an arrow 60, releasing medium clamp 20, and feeding print medium 14C from printer 10 by means of a conventional exit path mechanism (not shown).

Printer 10 properly registers high-resolution color images with a relatively simple and inexpensive mechanism. However, if even one dot of ink is transferred from a single color panel to form an image, ribbon 24 must be advanced to a new starting position before printing a subsequent image. This wastes almost three ribbon panels (four if ribbon 24 has a black panel) and requires considerable time to advance ribbon 24 to the new starting position.

U.S. Pat. Ser. No. 4,778,290 issued Oct. 18, 1988 for a PRINTER FOR PRINTING OF A FULL LINE IN SEVERAL COLORS BY INTERCHANGEABLE RIBBON CARTRIDGES describes a thermal printer having a single print head and a drum and medium clamp arrangement that provides multi-pass color registration of ink images transferred from multiple monochrome ribbons to a print medium wrapped around the drum. A carousel of multiple monochrome ribbon cartridges indexes an appropriate ribbon to a printing position adjacent to the drum. The print head, mounted within the carousel, is moved to form a nip between the print head and the drum through which the print medium and the ribbon are frictionally drawn by rotation of the drum. When printing is not desired, the print head is withdrawn a few millimeters to remove the ribbon-driving friction, thereby conserving ribbon material.

The ribbon carousel allows use of monochrome ribbons, improves ribbon utilization, and reduces the time required before a new image can be printed.

However, there are problems associated with mounting the thermal print head inside the carousel. Commercially available thermal print heads are physically large and dissipate a considerable amount of heat. Therefore, the carousel must provide print head clearance between each pair of ribbon spools, space for a print head heat sink, some heat removal means from inside the carousel, and a mechanism for moving the print head into contact with the ribbon. Such requirements result in an unduly large and massive ribbon carousel that requires expensive drum-to-ribbon-to-print head alignment structures and a complex print head moving mechanism.

Therefore, what is needed is a method and apparatus for thermal transfer printing with multiple monochrome ribbons and a commercially available print head but without the mechanical complexity previously associated with print head heat removal, print head movement, and drum-to-ribbon-to-print head alignment.

SUMMARY OF THE INVENTION

An object of this invention is, therefore, to provide an improved monochrome ribbon changing apparatus and method for improving ribbon utilization in a compact thermal transfer color printer.

Another object of the present invention is to provide an improved monochrome ribbon changing apparatus and method that readily allows positioning and cooling a commercially available thermal print head.

A further object of the present invention is to provide an improved monochrome ribbon changing apparatus and method that incorporates a simple print medium feed and exit path mechanism.

Still another object of the present invention is to provide an improved monochrome ribbon changing apparatus and method that provides inherently simple drum-to-ribbon-to-print head alignment.

A thermal transfer color printer, according to this invention, utilizes a single print head positioned outside a carousel of monochrome ink ribbons each stretched between a pair of spaced-apart spools mounted around the periphery of the carousel. The spool spacing provides sufficient clearance for a commercially available thermal print head to be moved into the space between the spools to contact the ribbon. A media drum is positioned coaxially within the carousel. The carousel has a media opening through which a print medium enters and exits a medium clamp that is attached to the media drum. To print a particular color, the carousel is rotated such that the media opening is adjacent to a media supply, and a print medium is guided from the media supply into the medium clamp. The media drum is rotated to close the medium clamp and position a leading edge of the print medium adjacent to the print head. The print head is moved against the ribbon, and the print head is electrically driven to selectively transfer ink to the print medium in a predetermined pattern. To print a different color, the carousel is indexed to a newly selected ribbon position, the media drum is rotated to position the leading edge of the print medium as before, and the printing process is repeated for the selected ribbon color. When printing is completed, the carousel is indexed to the initial printing position, and the print medium is guided from the medium clamp into the exit path.

Additional objects and advantages of this invention will be apparent from the following detailed description of a preferred embodiment thereof which proceeds with reference to the accompanying drawings.

DETAILED DESCRIPTION OF PREFERRED EMBODIMENT

Figure 1:
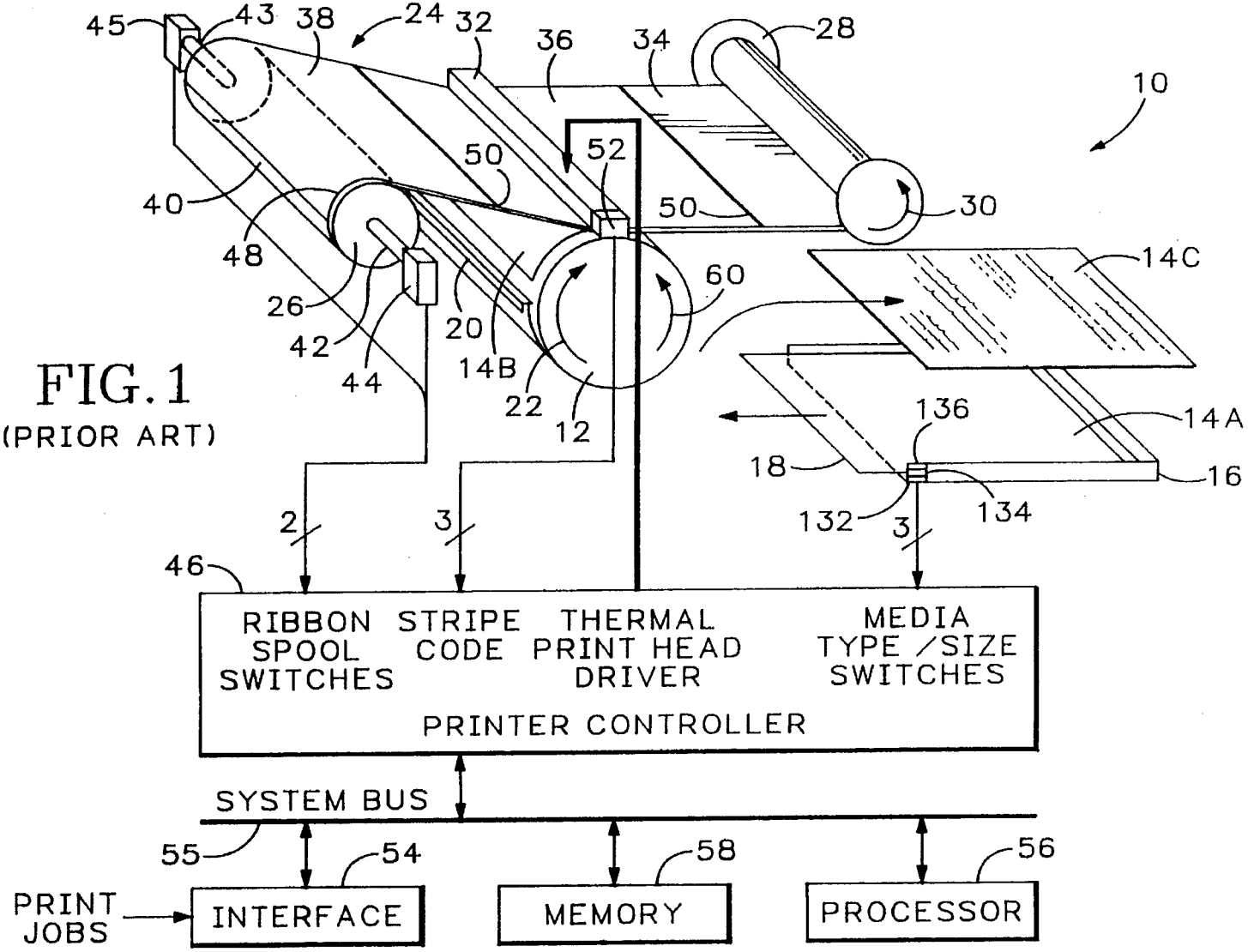
FIG. 1 (PRIOR ART)
FIG. 1 is a functional schematic diagram showing the interrelationship among the electromechanical components of a prior art multicolor ribbon thermal transfer printer.
Figure 2:
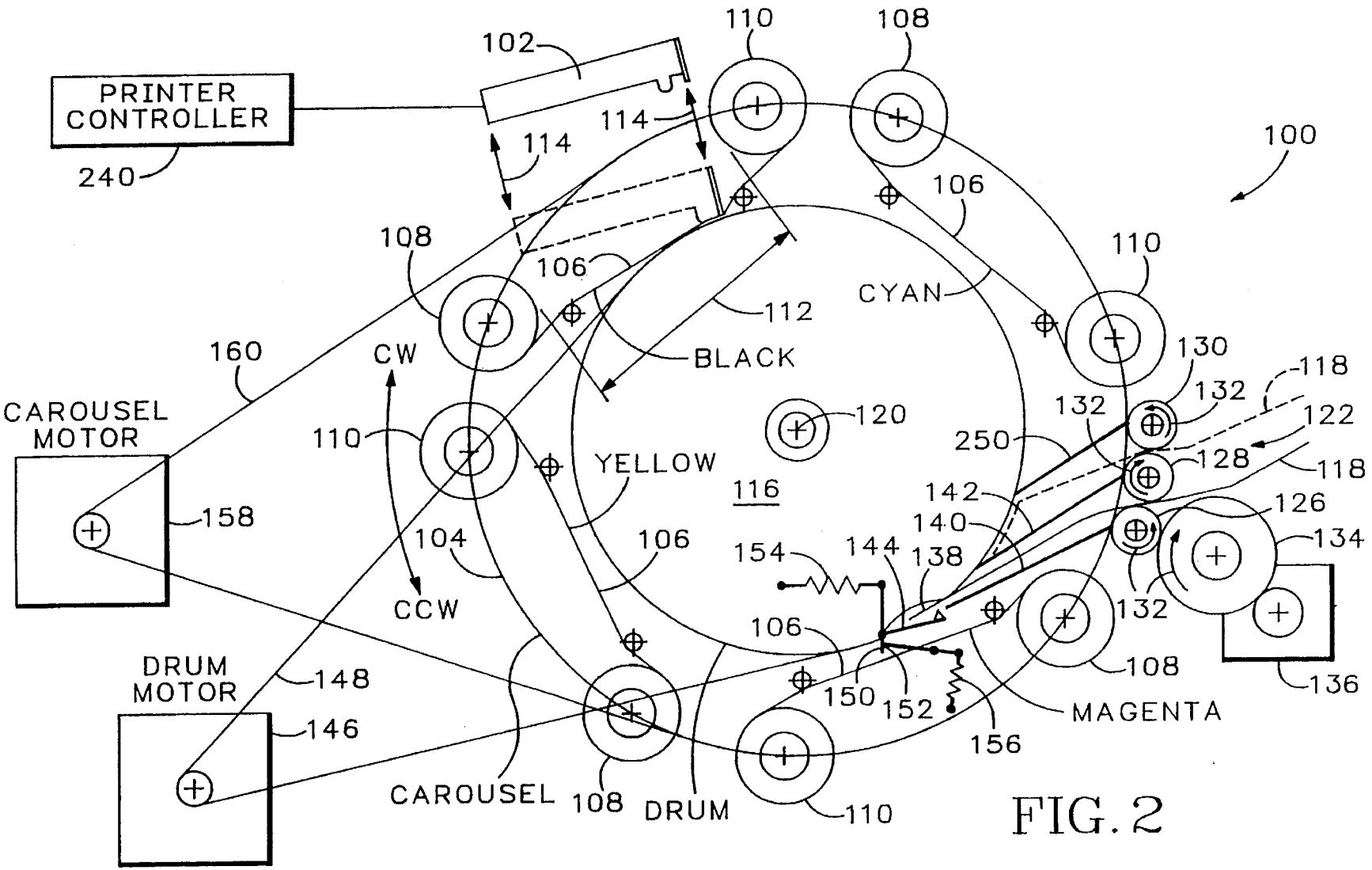
FIG. 2 is a schematic pictorial side elevation view showing the interrelationship among the major mechanical components of a multiple monochrome ribbon thermal transfer printer according to this invention.

FIG. 2 shows a thermal transfer color printer 100 (hereafter "printer 100") utilizing a single commercially available thermal print head assembly 102 positioned outside a carousel 104 that holds multiple monochrome ink ribbons 106. Thermal print head assembly 102 is preferably a commercially available type such as model no. KST-219-12MPL2-SH manufactured by Kyocera of Kyoto, Japan. Each of ribbons 106 are suspended between a supply spool 108 and a take-up spool 110 that are spaced apart around the periphery of carousel 104. Spools 108 and 110 are preferably about 2.5 centimeters in diameter and have a spool-to-spool spacing 112 of about 5.1 centimeters, sufficient to provide clearance for moving thermal print head assembly 102 in a direction indicated by arrows 114 between a retracted position (shown in solid lines) and a ribbon-contacting position (shown in dashed lines).

A media carrier, such as a media drum 116 is positioned coaxially within carousel 104. Media drum 116 has a diameter of about 12 centimeters, a size sufficient to hold A4-size media, and is coated with rubber to enhance media-to-drum dimensional stability and thermal transferability of ink to a print medium 118. In this configuration, media drum 116 also serves as a printing platen.

Alternative media carriers may include a series of rollers that transport a web of print media material. The rollers may be positioned within carousel 104 in a number of configuration. For example, three rollers having their rotational axes arranged in a triangular configuration in which one of the rollers also serves as a printing platen.

Both carousel 104 and media drum 116 rotate about a common axis of rotation 120 to maintain proper alignment of ribbons 106, print medium 118, and media drum 116 relative to thermal print head assembly 102. The overall diameter of carousel 104, preferably about 19 centimeters, is determined by the diameter of media drum 116, spools 108 and 110, and slight additional clearances for ribbon and print medium guides. The relative positionings of media drum 116, carousel 104, spools 108 and 110, and thermal print head assembly 102 provide a compact, relatively simple, inherently aligned, and thermally sound structure for printer 100.

Carousel 104 includes a media opening 122 through which print medium 118 enters and exits media drum 116. Media opening 122 includes a feed roller 126, an idler roller 128, and an exit roller 130 that are geared together and commonly driven in the contra-rotating directions indicated by arrows 132 by a drive gear 134. A media drive motor 136 rotates drive gear 134 that is positioned to mesh with feed roller 126 when carousel 104 is indexed to the black printing position shown in FIG. 2.

A leading edge 138 of print medium 118 is fed by conventional means into a nip formed between feed roller 126 and idler roller 128. Carousel 104 includes a feed guide 140 and a media guide 142 that direct leading edge 138 toward a medium clamp 144 on media drum 116.

Medium clamp 144 is opened by rotating media drum 116 with a drum motor 146 and drum drive belt 148 in a counter-clockwise ("CCW") direction until a clamp lever arm 150 contacts a clamp actuator 152 attached to carousel 104. Clamp lever arm 150 preferably extends from an end of medium clamp 144 to prevent interference with structures such as thermal print head assembly 102. After medium clamp 144 receives leading edge 138, a slight clockwise ("CW") rotation of media drum 116 allows medium clamp 144 to close. A spring 154 biases medium clamp 144 toward the closed position with a force sufficient to secure leading edge 138 of print medium 118. Clamp actuator 152 is biased toward media drum 116 by a spring 156 that allows clamp lever arm 150 to pass unimpeded under clamp actuator 152 when media drum 116 rotates in the CW direction. Once leading edge 138 is secured in medium clamp 144, media drum 116 rotates CW until print medium 118 clears media opening 122 and wraps around media drum 116. Print medium 118 is secured against media drum 116 by conventional bale rollers (not shown) that are attached to carousel 104.

To print a particular color image on print medium 118, carousel 104 is rotated CW by carousel motor 158 and carousel drive belt 160 until the appropriate ribbon 106 is indexed adjacent to thermal print head assembly 102. If black is the desired color, carousel 104 requires no rotation, a feature that facilitates relatively high-speed black printing, such as textual printing.

Figure 3:
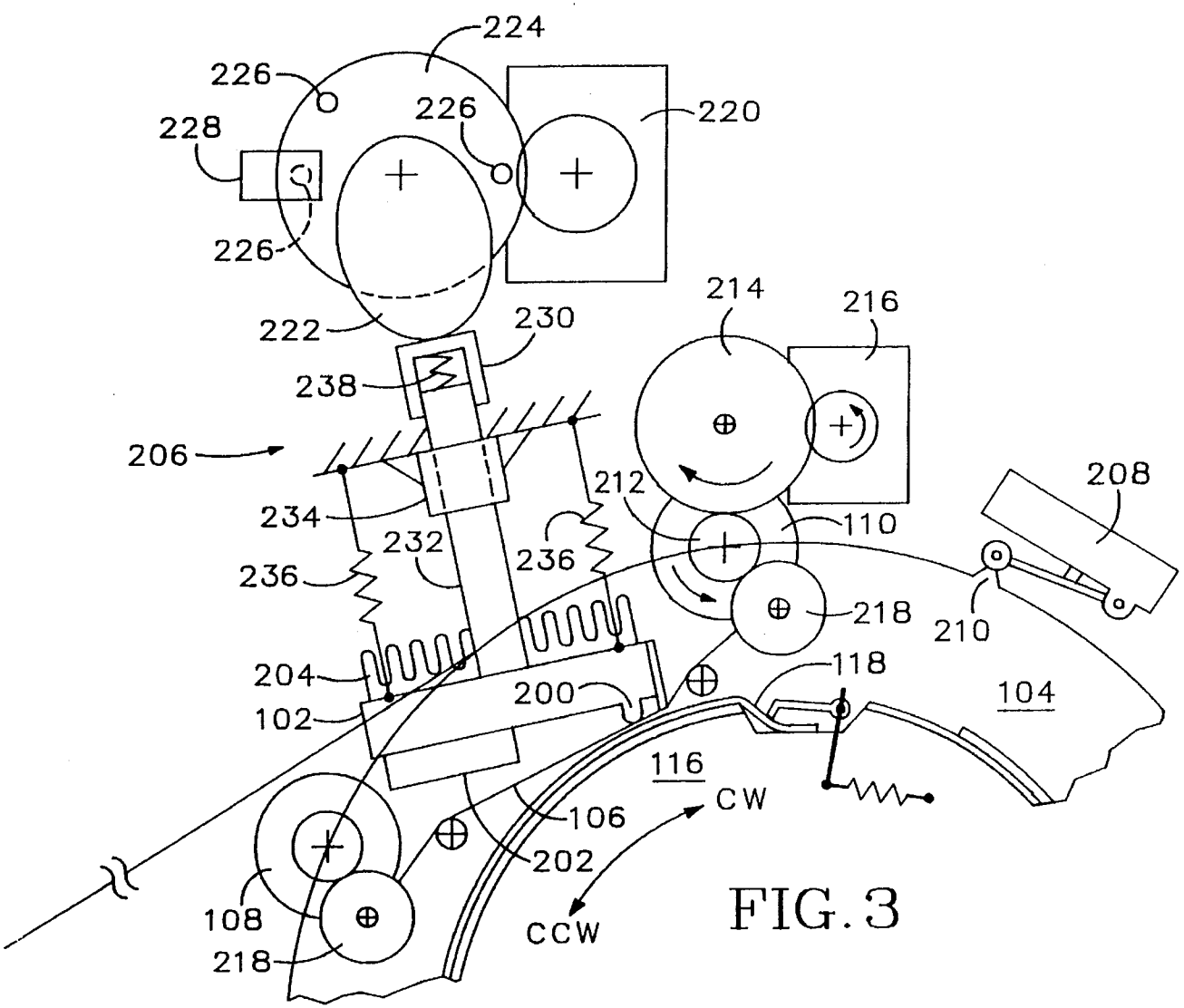
FIG. 3 is an enlarged fragmentary pictorial side elevation view schematically showing details of a cam-actuated thermal print head positioner, ribbon take-up spool drive, ribbon spool drag gears, and index position sensors according to the printer of FIG. 2.

FIG. 3 shows thermal print head assembly 102 moved into contact with ribbon 106 to form a nip between an array of heater elements 200 and media drum 116 through which ribbon 106 and print medium 118 are pulled by CW rotation of media drum 116.

Thermal print head assembly 102 is preferably of media width, about 5 centimeters, and is fabricated on a 3.53 centimeter wide ceramic substrate having 0.5 centimeter high heater array drivers 202 attached to one surface and a heat sink 204 attached to the other surface thereof. Thermal print head assembly 102 is positioned such that heater array drivers clear ribbon 106, ribbon supply spool 108, and ribbon take-up spool 110. Positioning thermal print head assembly 102 outside the volume enclosed by carousel 104 promotes heat dissipation from heat sink 204 and allows implementation of a simple print head positioner 206.

The precise rotational index position of carousel 104 is sensed by a microswitch 208 that is actuated by a bump 210 on carousel 104. Other bumps are positioned around the periphery of carousel 104 at appropriate indexing locations for each of ribbons 106. Carousel motor 158 is stopped in response to microswitch 208 to properly index ribbons 106 relative to thermal print head assembly 102.

Absolute encoding of index position may alternately be provided by a photosensor array that straddles a rim on carousel 104 and senses a unique hole pattern dedicated to each index position. Ribbon colors may also encoded by means such as ribbon spool hub length encoding as described in copending Patent application Ser. No. 07/994,383. Absolute encoding of both index position and ribbon color allows an intelligent controller to achieve color printing with a minimum of carousel 104 indexing.

A properly indexed ribbon 106 causes a gear 212 on take-up spool 110 to engage a ribbon drive gear 214 that is geared to a DC drive motor 216. The rotational torque of DC drive motor 216 characteristically decreases as the rotational velocity increases, thereby assisting ribbon 106 through the nip while winding used ribbon on take-up spool 110. The rotational torque characteristic of DC drive motor 216 also compensates for the relative proportion of ribbon 106 distributed between supply spool 108 and take-up spool 110.

A pair of drag gears 218 resist rotation of supply spool 108 and take-up spool 110 so that there is sufficient ribbon tension to prevent ribbons 106 from wrinkling and causing wax transfer-preventing creases from forming. Pairs of drag gears 218 are associated with each of ribbons 102 to positionally stabilize any of ribbons 106 not indexed to the printing position. An optional DC motor and gear may be engaged to supply ribbon 108 when it is in the printing index position to supply controllable amounts of drag beyond that available from drag gears 218.

Thermal print head assembly 102 is moved between the ribbon-contacting and retracted positions by print head positioner 206. In a first embodiment, a head positioning motor 220 rotates a cam 222 by means of gear 224. Predetermined rotational positions of cam 222 are encoded in gear 224 by holes 226 that are sensed by a photosensor array 228. Holes 226 are positioned to correspond to the retracted, ribbon-contacting, and a slightly retracted position of thermal print head assembly 102. Head positioning motor 220 is controlled in response to photosensor array 228 sensing the appropriate one of holes 226.

A follower 230 rides on cam 222 to translate the rotational positions of cam 222 into linear positions of a shaft 232 that slides in a bearing 234 and is attached to thermal print head assembly 102. Springs 236 bias thermal print head assembly 102 away from media drum 116 with a force sufficient to cause follower 230 to ride on cam 222. When thermal print head assembly 102 is in the ribbon-contacting position, a spring 238 compressed between follower 230 and shaft 232 biases thermal print head assembly 102 against ribbon 106 with a force suitable for printing on print medium 118 and for advancing ribbon 106 through the nip.

During printing, thermal print head assembly 102 is electrically driven by a conventional printer controller 240 (FIG. 2) that selectively heats elements of heater array 200, thereby melting and transferring wax-based ink carried in ribbon 106 to print medium 118. During periods of no printing, head positioning motor 220 drives gear 224 until the appropriate hole 226 is sensed by photosensor array 228, thereby positioning thermal print head assembly 102 slightly away from ribbon 106. The ribbon pulling force provided by media drum 116 and DC drive motor 216 is removed, thereby conserving ribbon 106. Periods of no printing can be as brief as the time required to rotate media drum 116 the equivalent of a single printed line.

Figure 4:
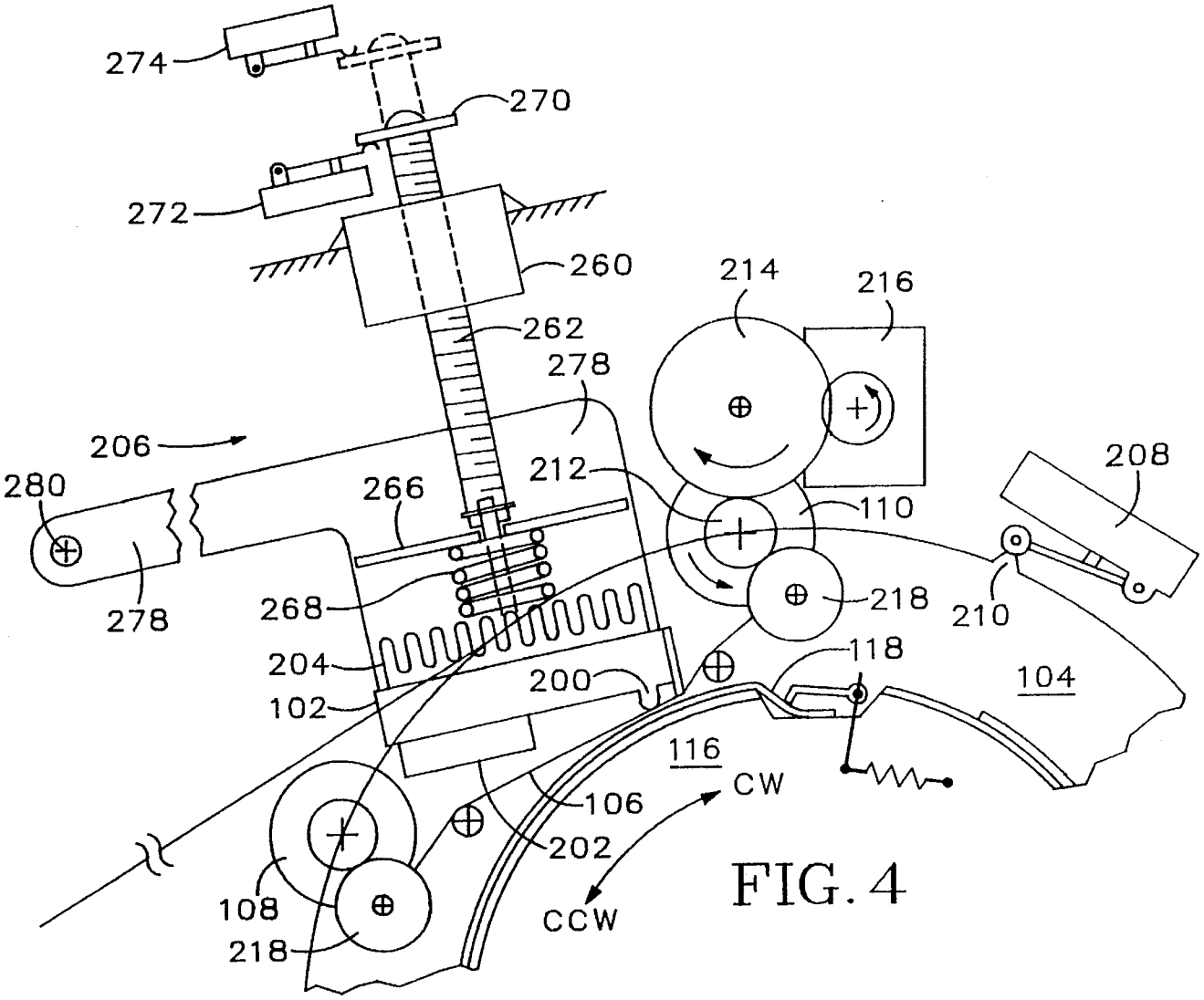
FIG. 4 is an enlarged fragmentary pictorial side elevation view schematically showing of a preferred lead screw-actuated thermal print head positioner, ribbon take-up spool drive, ribbon spool drag gears, and index position sensors according to the printer of FIG. 2.

FIG. 4 shows a preferred lead screw-actuated embodiment of print head positioner 206. Thermal print head assembly 102 is moved between the ribbon-contacting position shown and retracted positions by a head positioning motor 260 having a threaded core that rotates around and linearly actuates a lead screw 262 that is fixedly attached to a compression plate 266 which is biased away from thermal print head assembly 102 by a compression spring 268. Predetermined linear positions of a collar 270 on threaded shaft 266 are sensed by microswitches 272 and 274. The predetermined linear positions of collar 270 correspond to the ribbon-contacting head position shown being sensed by microswitch 272, a slightly retracted head position which is sensed when collar 270 moves away from microswitch 272, and a retracted head position (shown in dashed lines) being sensed by microswitch 274. Head positioning motor 260 is controlled in response to microswitches 272 and 274 sensing the appropriate predetermined positions of collar 270.

When thermal print head assembly 102 is in the ribbon-contacting position, compression spring 268 is compressed between compression plate 266 and heat sink 204 with a force suitable for printing on print medium 118 and for advancing ribbon 106 through the nip.

Thermal print head 102 is secured at one end of a swing arm 278 that rotates around a pivot bearing 280 located at the other end of swing arm 278.

Figure 5:
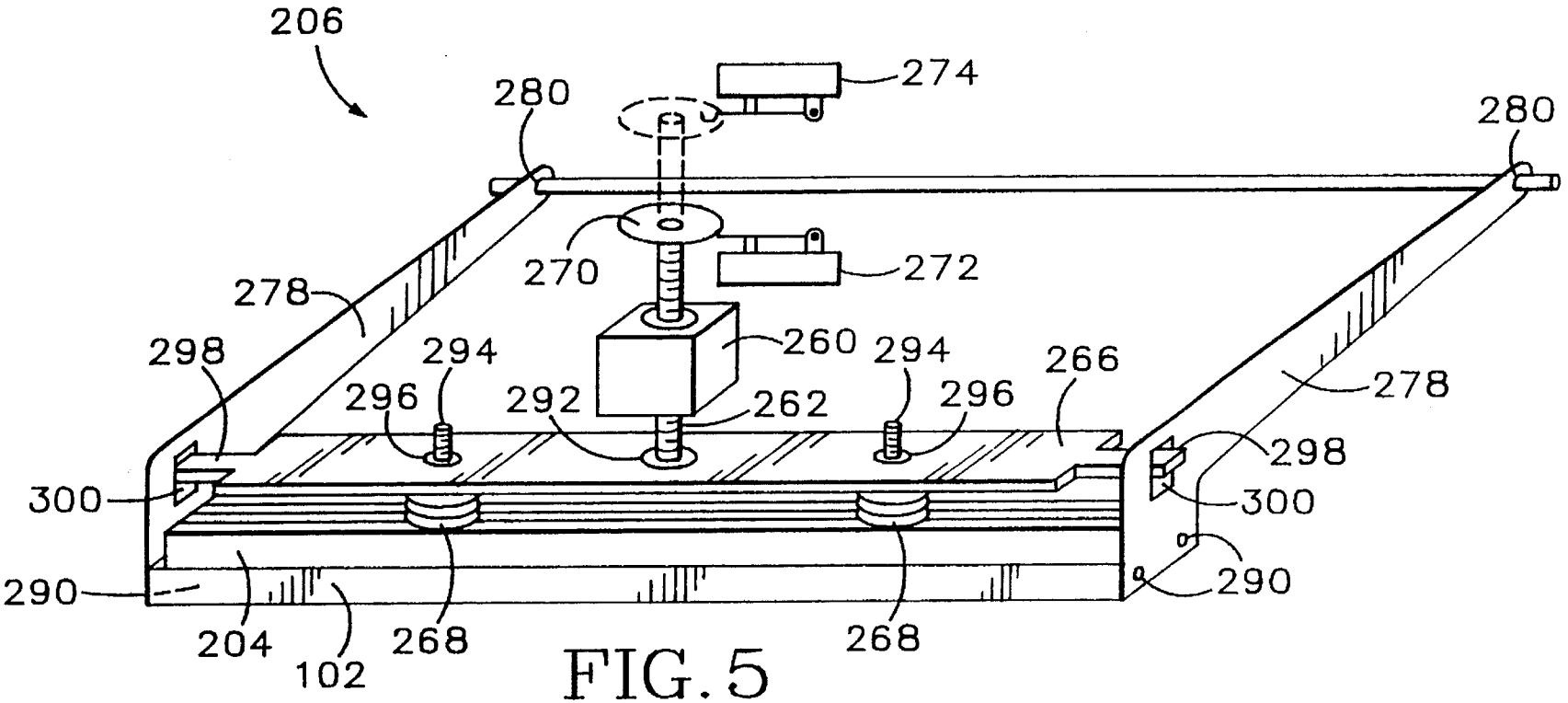
FIG. 5 is a simplified isometric pictorial view showing structural interrelationships among components of the preferred lead screw-actuated thermal print head positioner of FIG. 4.

FIG. 5 is an isometric view of head positioner 206 showing that swing arm 278 and compression spring 268 preferably comprise two pieces. Swing arms 278 are attached by conventional fasteners 290 to each end of thermal print head 102. Lead screw 262 is fixedly attached to compression plate 266 by an E-ring 292. Compression springs 268 are conventionally secured between compression plate 266 and heat sink 204 by pins 294, E-rings 296, and spring keepers (not shown). Vertical displacement of compression plate 266 is restricted by blades 298 that protrude through clearance holes 300 in swing arms 278.

Referring again to FIG. 2, printing with a different one of ribbons 106 entails first moving thermal print head assembly 102 to the retracted position with print head positioner 206. Carousel 104 is then indexed to the desired ribbon position, media drum 116 is rotated CW to position leading edge 138 of print medium 118 to the initial printing position, thermal print head assembly 102 is moved to the ribbon-contacting position, and the printing process is repeated for the newly selected ribbon color.

When printing is completed, thermal print head assembly 102 is moved to the retracted position, carousel 104 is rotated CW to the black ribbon index position, and media drum 116 is rotated CCW to open the medium clamp, while print medium 118 (shown in dashed lines) is pulled between media guide 142 and an exit guide 250 by idler roller 128 and exit roller 130. Print medium 118 is subsequently delivered into a conventional exit path (not shown).

Alternative embodiments of portions of this invention can include using other than yellow, magenta, cyan, and black ribbons; other than a drum-type print media carrier; greater or fewer than four ribbons; use of more than one black ribbon; use of a media pre-coat ribbon; spool hub-length encoding of ribbon colors; print head positioning by a solenoid, escapement, or lever arms; and use of indexing sensors other than microswitch and photosensor array types. Skilled workers will also understand the applicability of this invention to a variety of printing technologies including thermal wax transfer and dye diffusion thermal transfer printing.

It will be obvious to skilled workers that many changes may be made to the details of the above-described embodiments of this invention without departing from the underlying principles thereof. Accordingly, it will be appreciated that this invention is also applicable to printing applications other than those found in the field of thermal transfer printing. The scope of the present invention should be determined, therefore, only by the following claims.

I claim:

1. In a printer having multiple colorant-carrying ribbons, a method for printing an image, comprising the steps of:

spacing the multiple ribbons around a periphery of a generally cylindrical carousel having an axis of rotation;

positioning a print head outside the carousel periphery, the print head having a linear array of printing elements aligned parallel to the axis of rotation;

mounting a media carrier inside the periphery of the carousel;

placing a print medium on the media carrier;

indexing the carousel to position a first one of the ribbons adjacent to the print head;

moving the print head against the first ribbon to form a nip between the first ribbon and the media carrier;

transporting the print medium and the first ribbon through the nip; and driving the array of printing elements to cause a controlled transfer of a first colorant from the first ribbon to the print medium, thereby printing the image on the print medium.

2. The method of claim 1 further including the step of moving the print head away from the first ribbon during a period of no printing such that the transporting step moves only the print medium through the nip.

3. The method of claim 1 in which the image is a multicolor image, and the method further includes the steps of:

moving the print head away from the first ribbon;

indexing the carousel to position a second one of the ribbons adjacent to the print head;

moving the print head against the second one of the ribbons to form the nip between the second one of the ribbons and the media carrier;

actuating the media carrier to move the second one of the ribbons and the print medium through the nip; and driving the array of printing elements to cause a controlled transfer of a second colorant from the second one of the ribbons to the print medium, thereby printing the multicolor image on the print medium.

4. The method of claim 1 in which the media carrier comprises a media drum that is coaxially mounted inside the carousel, and the carousel includes a media opening between two adjacent ribbons, and the placing step further comprises the steps of:

feeding the print medium through the media opening;

securing a leading edge of the print medium to the media drum; and actuating the media carrier to wrap the print medium around the media drum.

5. The method of claim 4 further including the step of removing the print medium from the media drum through the media opening after printing the image on the print medium.

6. The method of claim 4 in which the securing step further comprises the steps of:

providing a medium clamp on the media drum, the medium clamp being mechanically coupled to the carousel;

rotating the media drum in a first direction relative to the carousel to open the medium clamp;

feeding the leading edge of the print medium into the open medium clamp; and rotating the media drum in a second direction relative to the carousel to close the medium clamp.

7. An apparatus for printing a multicolor image on a print medium, comprising:

a generally cylindrical carousel having an axis of rotation and a periphery around which a plurality of colorant-carrying ribbons are attached;

a print head positioned outside the carousel periphery, the print head having a linear array of printing elements aligned parallel to the axis of rotation;

a media drum coaxially mounted within the carousel, the print medium being wrapped around the media drum;

a carousel motor rotating the carousel to sequentially index a selected one of the plurality of ribbons to a position adjacent to the print head thereby permitting the plurality of ribbons to be selected and indexed;

a print head positioner moving the linear array of printing elements between a retracted position that allows the carousel to be rotated and a ribbon-contacting position that forms a nip between the selected one of the plurality of ribbons and the media drum;

a drum motor rotating the media drum to move the print medium and the selected one of the plurality of ribbons through the nip in sequential passes, the drum motor sequentially passing the, print medium through the nip to permit subsequently selected ones of the plurality of ribbons to contact the printing elements of the print head; and a print head array driver controlling transfer of colorant from the sequentially indexed and selected one of the plurality of ribbons during sequential and subsequent passes of the print medium and the plurality of ribbons through the nip, thereby printing the multicolor image on the print medium.

8. The apparatus of claim 7 in which the print head positioner moves the print head to a position away from the selected one of the plurality of ribbons during a period of no printing such that only the print medium is moved through the nip, thereby conserving the selected one of the plurality of ribbons.

9. The apparatus of claim 7 in which the carousel further includes a media feed roller and an idler roller mounted between two adjacent ribbons and forming a first nip through which a leading edge of the print medium is fed into a medium clamp on the media drum.

10. The apparatus of claim 9 in which the carousel further includes a media exit roller that forms with the idler roller a second nip through which the print medium is removed from the media drum.

11. The apparatus of claim 10 in which at least one of the rollers has a gear that causes the rollers to be commonly driven in contra-rotating directions.

12. The apparatus of claim 11 in which the gear engages a drive gear mounted outside the periphery of the carousel when the carousel is rotated to a media loading and unloading index position.

13. The apparatus of claim 12 in which the media loading and unloading index position coincides with a black ribbon printing carousel index position.

14. The apparatus of claim 9 in which the medium clamp is mechanically coupled to the carousel such that rotating the media drum in a first direction relative to the carousel opens the medium clamp and rotating the media drum in a second direction relative to the carousel closes the medium clamp.

15. The apparatus of claim 7 in which the print head and ribbons are of a thermal transfer printing type.

16. The apparatus of claim 7 in which the print head positioner employs a cam or a lead screw coupled to a linearly moving shaft.

17. The apparatus of claim 7 in which the head positioner includes a position sensor that senses when the print head is in a retracted, a ribbon-contacting, or a partially retracted position.

18. The apparatus of claim 7 further including a carousel index sensor that senses when the selected one of the plurality of ribbons is positioned adjacent to the print head.

19. The apparatus of claim 7 in which the plurality of ribbons are suspended between associated supply and take-up spools that are spaced apart to provide clearance for the print head.

20. The apparatus of claim 19 in which the supply and take-up spools are each fitted with a rotational drag device that provides positional stability for the plurality of ribbons.

21. The apparatus of claim 19 further including a ribbon drive gear that is mounted outside the periphery of the carousel and in which the take-up spools are each fitted with a take-up gear such that the take-up gear of the selected ribbon engages the ribbon drive gear.

22. The apparatus of claim 21 in which the ribbon drive gear is coupled to a DC motor that provides a rotational torque to the take-up spool of the selected one of the plurality of ribbons that is sufficient to wind the ribbon onto the take-up spool only when an additional ribbon-moving force is applied to the selected one of the plurality of ribbons by the media drum.

* * * * *